United States Patent [19]

Comartin

[11] Patent Number: 4,969,651

[45] Date of Patent: Nov. 13, 1990

[54] FLEXIBLE PROJECTILE ARRESTING DEVICE

[76] Inventor: Craig D. Comartin, 226 S. Ham La., Lodi, Calif. 95242

[21] Appl. No.: 482,291

[22] Filed: Feb. 20, 1990

[51] Int. Cl.[5] ..... A63B 71/00

[52] U.S. Cl. ..... 273/410; 272/3; 273/26 A; 273/29 B; 273/181 F; 273/411

[58] Field of Search ..... 273/410, 411, 26 A, 273/29 B, 181 F; 272/2, 3

[56] References Cited

U.S. PATENT DOCUMENTS

| | | | |
|---|---|---|---|
| 1,540,670 | 6/1925 | Vidmer | 273/410 X |
| 2,922,653 | 1/1960 | O'Brien | 273/410 X |
| 3,593,997 | 7/1971 | Boehner | 273/26 A X |
| 4,072,295 | 2/1978 | Roberts | 273/26 A X |
| 4,078,795 | 3/1978 | Porter | 272/3 |
| 4,127,267 | 11/1978 | Bay et al. | 273/26 A |
| 4,715,598 | 12/1987 | Knight | 273/411 X |

*Primary Examiner*—William H. Grieb

[57] ABSTRACT

The flexible projectile arresting device is used typically in the playing or practicing of a ball game such as baseball, golf or soccer to restrict the flight of the ball to a limited area. The elements of the device include side and roof panels of flexible material, such as netting, loosely suspended by cord or rope between rigid compression struts or poles at corners. The struts are inclined so as to be located behind the panels out of the path of the ball or projectile. The tops of the struts are restrained by tension guys secured at the ground. The device moves upon impact by the projectile thereby absorbing and dissipating kinetic energy and preventing dangerous rebound. The device returns to its original shape after impact.

4 Claims, 6 Drawing Sheets

FLEXIBLE PROJECTILE ARRESTING DEVICE

FIELF OF INVENTION

Figure 1:
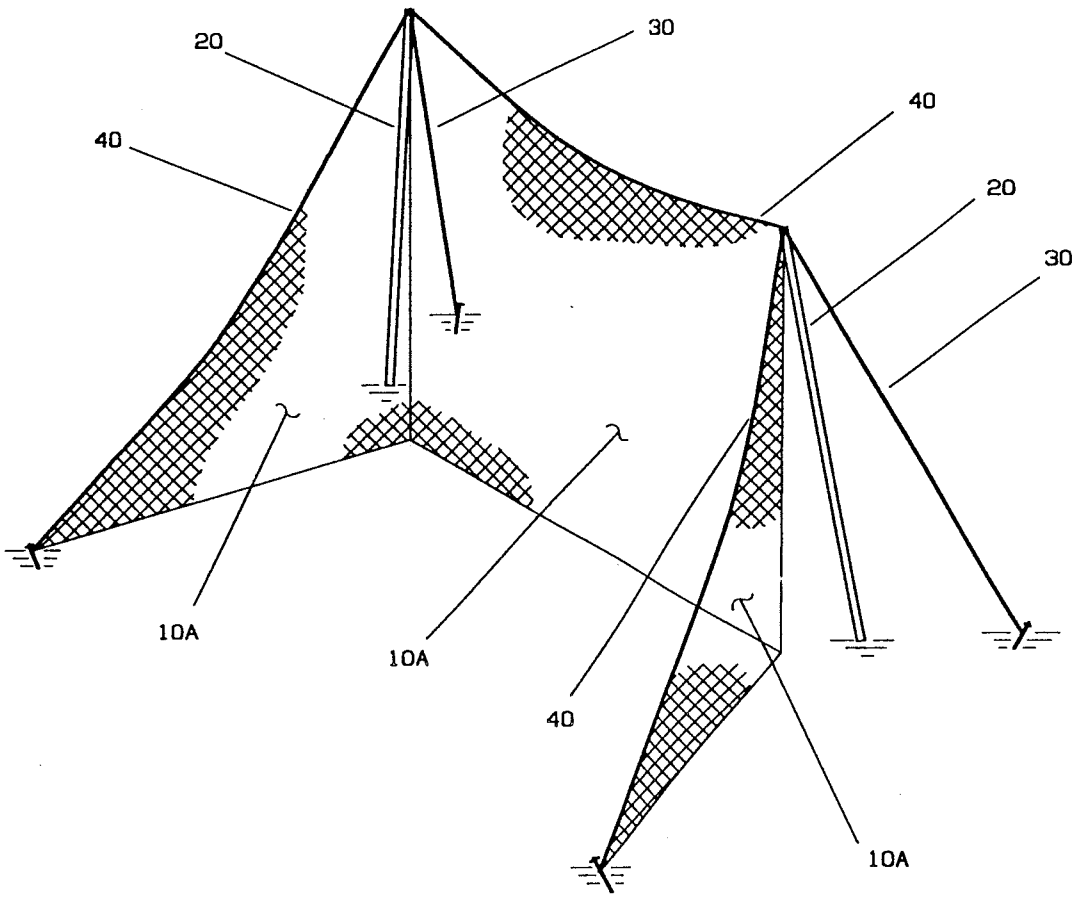

The field of the present invention includes barriers and enclosures utilized to arrest the flight of projectiles. Specific applications include screens, backstops, nets, and cages for the purpose of stopping the flight of a game ball during the playing or practicing of sports such as baseball, soccer, golf and tennis.

BACKGROUND

Many ball games either require or are enhanced by devices which restrict the movement of the ball. For example, most baseball playing fields include a backstop located behind home plate consisting of a vertical screen, commonly extending toward first and third base for some distance, and often with an overhead roof component. The purpose is to prevent the ball from leaving the immediate area of play when thrown or struck into the backstop. The result is one of both utility and safety since spectators may locate behind the backstop for protection. In most instances these barriers are permanent structures consisting of steel chain link or wire screens supported by steel or wood frames. Although this type of construction is generally durable, it is also relatively expensive. Furthermore, the barrier normally must be utilized where originally built since relocation is difficult. The fields on which they are constructed often may not be utilized for other sports or activities due to the physical restrictions which they impose. For example, permanent baseball backstops can impede the seasonal use of otherwise large open areas for soccer or football. Semi-portable devices are known, such as backstops and cages with wheels attached thereto. Other relatively small devices have been built without permanent attachment to the ground to allow for manual relocation. U.S. Pat. No. 4,072,295 to Roberts (1976) discloses a foldable, transportable backstop. However, the ease and speed of relocation of such existing devices is arguable.

The practice of many ball games is also aided by the use of projectile arresting devices. Baseball pitchers can practice without a catcher by throwing balls into a backstop or screen. Similarly, a batter may hit balls off a tee into such devices. Pitchers and batters often practice together in a cage-like enclosure which restricts the flight of the ball to a predetermined limited area. Many such practice devices are at least semi-portable. The most common construction consists of netting suspended between rigid support posts or frames which are in turn often stabilized by tension guys to the ground plane. As an example, U.S. Pat. No. 3,593,997 to Boehner (1971) discloses a batting cage of this type of construction. In actual use this type of construction imposes several disadvantages. Balls may strike the rigid material resulting in damage over the long term. The rigid materials can also cause high energy rebounding of the ball resulting in a safety hazard or other undesirable performance characteristics. High energy rebounding can also be caused by the tautness of the screen or its supporting ropes or cords. Such construction can be difficult to assemble and adjust to the desired shape. Also, these structures can tend to lose shape and stability with use. U.S. Pat. No. 4,127,267 to Bay and DiMarco (1977) discloses a device with improved energy absorbing capability over previous devices. This is accomplished by removing rigid materials from the path of the projectiles and by hanging the netting relatively loosely from its supporting frame. This device also returns to its proper shape by gravity after impact by the projectile. These improvements, however, are the result of a collapsible support which is relatively complicated, heavy, and expensive to manufacture.

The primary disadvantages of currently known projectile arresting devices utilized as screens, backstops, nets, and cages for the purpose of restricting the flight of a game ball during the playing or practicing of sports such as baseball, soccer, golf and tennis are summarized as follows:

1. They are often permanent structures which are difficult to relocate and expensive to construct.
2. Portable devices are often heavy and otherwise difficult to assemble and transport.
3. Many devices tend to loose their shape and stability after use.
4. Rigid elements are subject to damage when struck by projectiles.
5. Rigid elements tend to reflect projectiles without dissipating kinetic energy leading to potentially unsafe operating conditions.
6. Taut screens and highly tensioned support ropes and cords tend to reflect projectiles without dissipating kinetic energy leading to potentially unsafe operating conditions.
7. Devices which address some of the previously mentioned disadvantages are expensive to manufacture.

OBJECT AND ADVANTAGES

The present invention mitigates each of the above noted disadvantages of currently known projectile arresting devices. Specifically, some of the objects and advantages are:

1. All rigid materials are located outside of the potential path of the projectiles.
2. The barrier which arrests the flight of the projectiles is completely flexible.
3. The potential for high energy rebound of the projectile is minimized.
4. The kinetic energy of the projectile is absorbed and dissipated safely by the response of the device to the impact of the projectile.
5. The device retains its original shape after repeated use.
6. Assembly and disassembly of the device is easy and does not require skilled labor, special tools, or equipment.
7. The device can quickly and easily relocated.
8. The materials of construction for the device may be extremely light in weight.
9. The materials of construction are commonly available; the manufacture does not require skilled labor nor sophisticated equipment or processes; and, consequently, the device is very inexpensive.

Further objects and advantages will become apparent from a consideration of the ensuing description and dicussion of the operation of the device.

DRAWINGS

Figure 2:
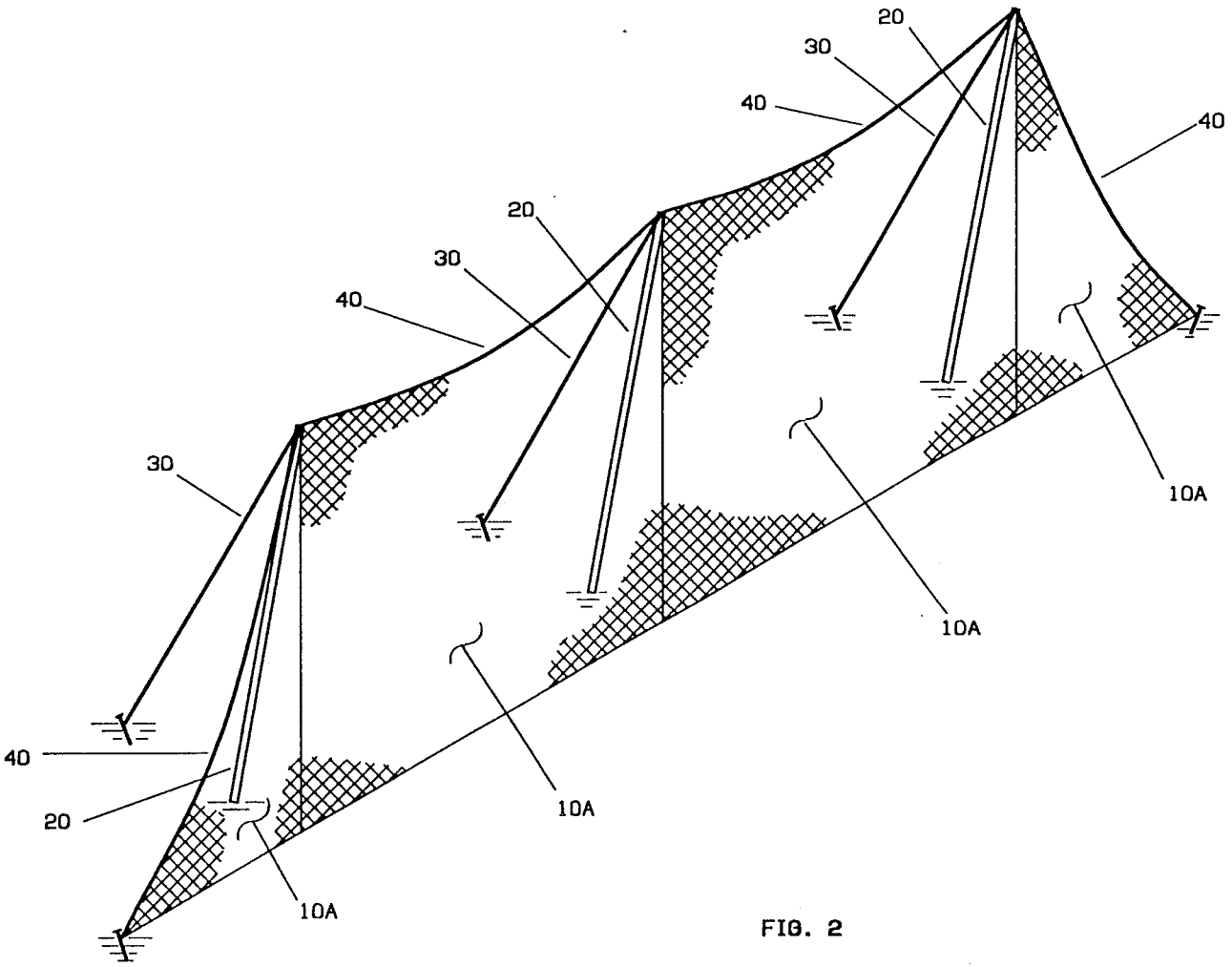
Figure 3:
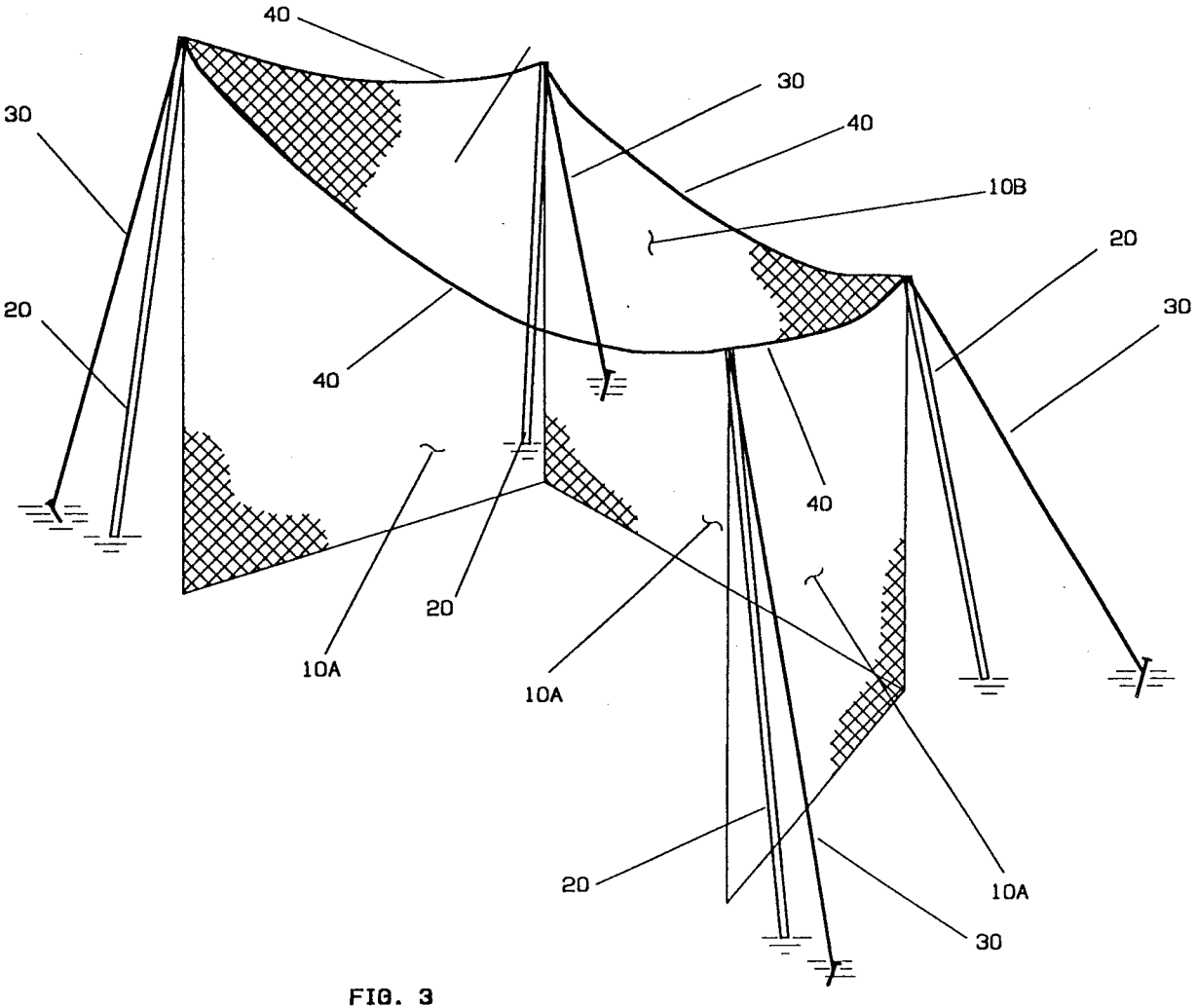
Figure 4:
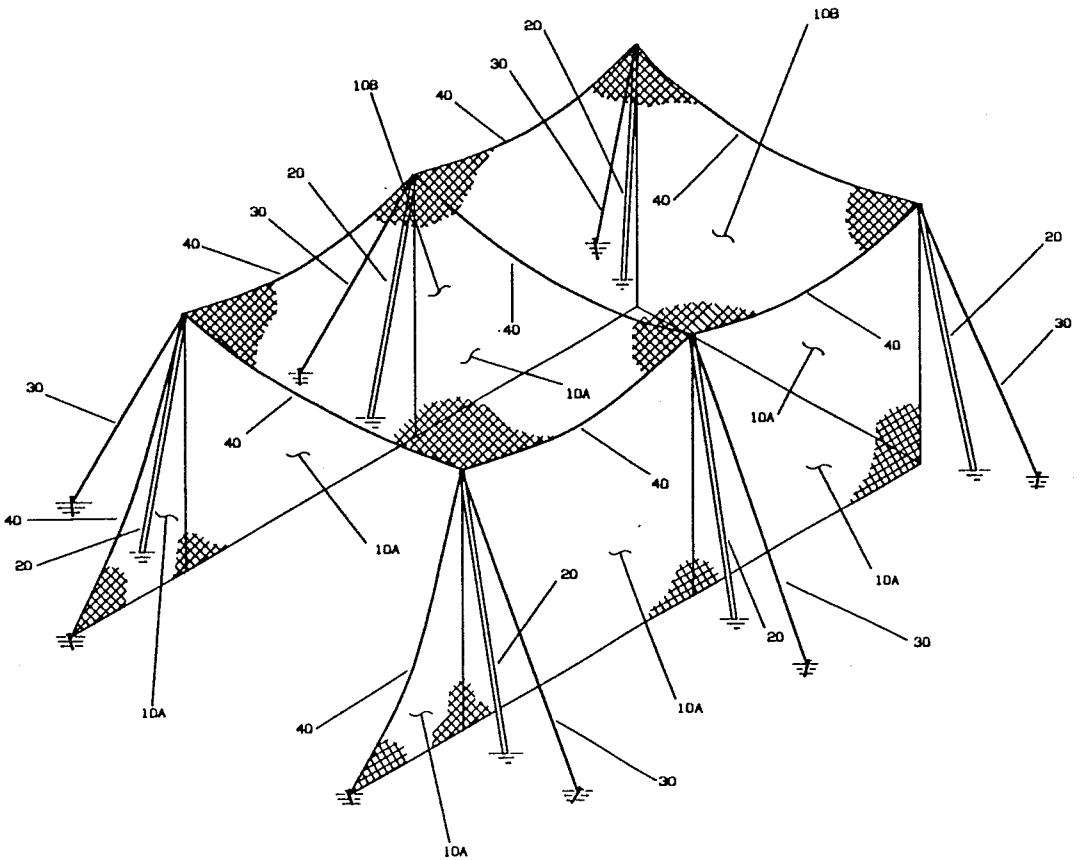
Figure 5:
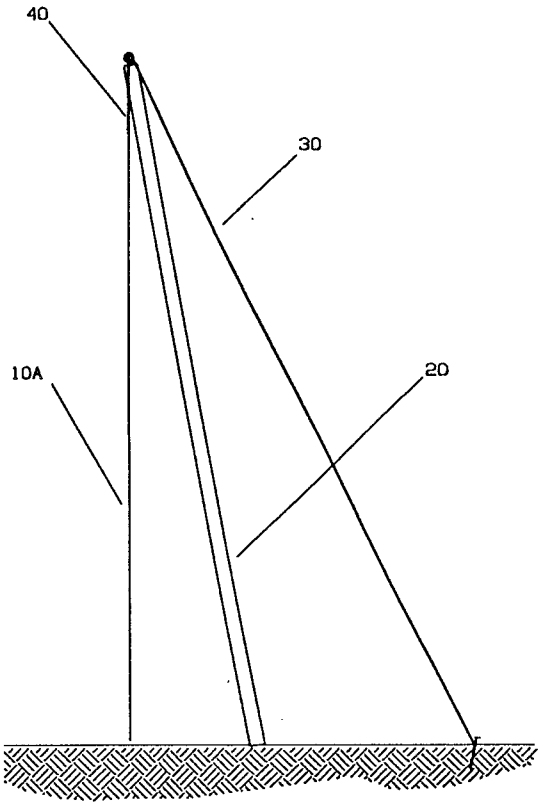
Figure 6:
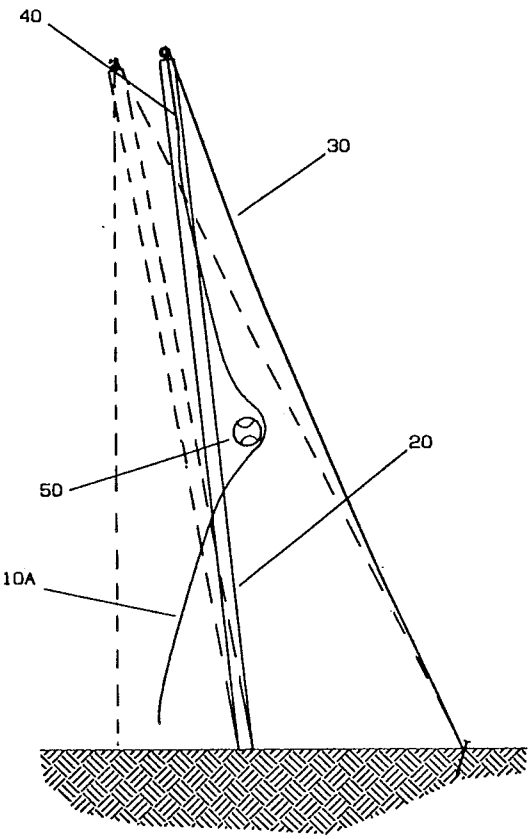

The drawings included herewith to illustrate the features of the present invention are:

FIG. 1—Isometric View of a Screen Embodiment
FIG. 2—Isometric View of a Fence Embodiment
FIG. 3—Isometric View of a Backstop Embodiment
FIG. 4—Isometric View of a Cage Embodiment FIG. 5—Typical Section at Rest
FIG. 6—Typical Section Under Impact.

The key to the reference numerals utilized in the drawings is as follows:

10A; Side Panel
10B; Roof Panel
20; Inclined Compression Strut
30; Tension Guy
40; Draped Tension Reinforcement
50; Projectile.

DESCRIPTION

Several embodiments of the present invention are illustrated in FIGS. 1 to 6. Each embodiment is assembled from four basic components:

10A—Side Panels
10B—Roof Panels
20—Inclined Compression Struts
30—Tension Guys
40—Draped Tension Reinforcement.

The purpose of the panels (10A and 10B) is to interrupt the flight of the projectile. The panels may be fabricated from a number of different flexible sheet materials including cloth, canvas, plastic, or mesh netting. For most applications it is desirable that the panel not present a visual barrier and mesh netting may be preferred in these instances. The size of the mesh opening and the strength of the netting material depend upon the characteristics of the projectile and the desired durability of the device. For example, the mesh size for a golf application is necessarily smaller than that for soccer. Netting used for commercial fishing comes in a variety of mesh sizes and strengths and is commonly available.

Panels are supported by draped tension reinforcement (40). These are linear flexible components such as rope, wire, or cord. The strength and material requirements of the draped tension reinforcement depend upon the nature of the intended application of the device and particularly upon the weight and configuration of the suspended panels. For applications utilizing the mesh netting described above, rope is a typical suitable material.

The draped tension reinforcement is supported upon inclined compression struts (20). These struts are fabricated from rigid linear material such as wood poles, polyvinyl chloride pipe, aluminum or steel tubing. The size and strength requirements for the struts depend upon the weight of the panels and draped tension reinforcement and upon the height of the device as it affects the buckling stability of the strut. The strut may be fabricated sectionally, as with couplings, to allow for ease of transport and relocation.

The upper ends of the compression struts are restrained by tension guys (30). These guys are of flexible linear material such as rope, wire, or cord. The size and strength of the material depends the weight of the other components of the device including the panels, draped tension reinforcement, and compression struts.

The panel material is attached to draped tension reinforcement in a manner such that the panel material is not tightly stretched when in place. The width of the panel material when stretched out horizontally should be somewhat greater than the horizontal dimension of the panel in place. This may be accomplished by gathering of the material along the draped tension reinforcement. The result is a greater capacity of the panel to dissipate the kinetic energy of a projectile upon impact and a diminished potential for high energy rebound of the projectile. The normal means of attaching rope to mesh netting consists of simply weaving the rope through the mesh. The netting may be further secured to the rope by tying with cord or twine as is commonly done for commercial fishing nets. Alternatively, metal rings or clips may be utilized which engage both the rope and the mesh. Other means may be appropriate depending upon the materials utilized for the panels and the draped tension members.

Panel material may be folded to form adjacent panels as with roof and side panels in FIGS. 1 to 6.

The draped tension reinforcement is fastened to the upper ends of the compression struts by a means of attachment such as a metal clip engaging an eye bolt at the top of the strut. The tension guy may be attached to the upper end of the compression strut in a similar manner. The lower end of the tension guy is affixed to a stake, deadman, or other means of horizontal and vertical restraint at the ground plane. The lower end of a draped tension reinforcement in a wing panel might be similarly restrained as in FIG. 1. The base of the inclined compression strut is also restrained against horizontal and vertical movement at the ground plane. FIG. 5 illustrates the assembly of the components common to each of the embodiments utilized for support of the device.

The basic components described may be assembled into a variety of flexible projectile arresting devices. FIG. 1 illustrates a rectangular rear side panel with a triangular wing side panel on each side making a horizontal angle with the rear side panel. These side panels are supported by a pair of inclined compression struts and tension guys located behind the side panels. An expansion of this simple embodiment is shown in FIG. 2 which depicts a fence-like device utilizing a plurality of rectangular side panels in conjunction with triangular wing panels at each end. Support is provided by inclined compression struts and tension guys behind the intersection of the side panels. The addition of a roof panel is illustrated in FIG. 3. In this embodiment rectangular or trapezoidal side panels are placed on each side of a rectangular rear panel. A roof panel is attached to the tops of each side panel to form a backstop-like device supported by four inclined compression struts and tension guys. This embodiment may expanded to form a cage-like device as shown in FIG. 4.

OPERATION

Erection of the subject projectile arresting device is similar for each of the embodiments previously discussed. The side and roof panels are spread out upon the ground plane in the vicinity of the desired location of the device when assembled. The restraint means for the inclined compression struts and the tension guys are placed at the proper position on the ground plane. The lower end of the tension guys are attached to the ground plane restraint means. The upper ends of the tension guys are attached to the upper ends of the inclined compression struts as are the panels and the draped tension reinforcement. The device is then erected by simply raising the upper ends of the inclined compression strut and attaching the lower ends to the ground plane restraint means. The assembly process is quite like erecting a tent structure.

Once assembled the projectile arresting device is generally utilized to interrupt the flight of an object such as a game ball. For example, either of the embodiments shown in FIGS. 1 and 3 might be used as backstop in a game of baseball. The device is located behind home plate to prevent a ball which is thrown, or hit with a bat, from leaving the immediate vicinity of the field of play. The same embodiments might also serve as practice devices wherein a pitcher throws balls into the device or a batter hits balls off a tee into the device. A pitcher and batter might practice together in a cage-type embodiment as shown in FIG. 4.

Prior to the impact of a projectile, the device remains at rest in the position illustrated in FIG. 5. The weight of the panels imposes a downward vertical force at the upper ends of the inclined compression struts. The inclined compression struts tend to rotate under the imposed force but are restrained against rotation by the tension guys. The deformed position of the device as it is struck by a projectile is illustrated in FIG. 6. The kinetic energy of the projectile is imparted to the flexible panel as it deforms under impact. The deformation of the panel results in a change of direction of the force imparted by the panel at the upper end of the inclined compression strut. The strut rotates upward slightly and the tension guy slackens. The momentum of the projectile is thereby transferred to the elements of the device and the projectile falls to the ground plane. The effect of gravity causes the flexible panel to return to its at rest position. Consequently, the inclined compression strut rotates downward to its original position and the tension guy is retightened. The kinetic energy of the projectile is dissipated as the device moves from the at rest to deformed position and back again.

PROTOTYPE

A working prototype model of the present invention, as described herein, has been assembled in general accordance with the embodiment illustrated in FIG. 1. The prototype was approximately eight feet high and twenty feet wide. Side panels were one and three quarter inch by one and three quarter inch square mesh fishing net. Tension guys and draped tension reinforcement were of three eighths inch diameter nylon rope. Inclined compression struts were fabricated from one inch inside diameter polyvinyl chloride pipe. The prototype weighed approximately fifteen pounds. The time required for assembly or disassembly of the prototype was approximately five minutes. The prototype was tested extensively utilizing a baseball thrown or struck with a bat into the device at high speed.

SUMMARY

The flexible projectile arresting device of the present invention as described herein and as verified by the results of prototype testing is highly effective in interrupting the flight of a projectile and dissipating its energy. Furthermore, the present invention demonstrates the following distinct advantages not previously available in a single device. Specifically,:

1. The only rigid material in the device are the inclined compression struts which are located such that they are behind the side panels and not in the path of the projectile.
2. The side and roof panels which are impacted by the projectile are completely flexible.
3. The device consequently minimizes the potential for dangerous high energy rebound of the projectile.
4. The kinetic energy of the projectile is effectively dissipated by the movement of the device in response to the impact of the projectile.
5. The device returns to its original shape under the effects of gravity after impact by a projectile.
6. The assembly and disassembly of the device requires no special tools or labor skills.
7. The relocation of the device is a simple and quick procedure.
8. The device is extremely light weight.
9. The materials of construction for the device are commonly available and very inexpensive.

Although the above description contains a number of specificities, these should not be construed as limiting the scope of the present invention but merely as providing illustrations of some of the embodiments of the present invention. For example, the device can have many other shapes depending upon the specific application of the general principle of the present invention. Furthermore, the general principle of the present invention may be extended to functions other than that described herein as a projectile arresting device. For example, the principle of the present invention might be utilized in the construction of tents, enclosures, or screens for a number of uses. Accordingly, the scope of the present invention is not determined by the embodiments illustrated but by the appended claims and their legal equivalents.

I claim:

1. A flexible projectile arresting device comprising:

(a) a plurality of essentially vertical side panels of flexible two-dimensional material, said side panels being arranged contiguously in plan with vertical edges of adjacent said side panels attached continuously to one another at panel intersections and with lower edges of said side panels lying in a common horizontal ground plane; and means of attachment therefor;

(b) inclined compression struts of rigid linear material at each said intersection, the lower end of said inclined compression strut located in said ground plane, the upper end of said inclined compression strut located at the upper end of said intersection, said inclined compression strut making an angle with the vertical;

(c) tension guys of flexible linear material attached to each said inclined compression strut, said tension guy being attached to and extending from the ground plane to the upper end of said inclined compression strut, said tension guy making an angle with the vertical greater than that of said inclined compression strut; and means of attachment therefor;

(d) draped tension reinforcement of flexible linear material located continuously along and attached to the upper edges of each said side panel, said draped tension reinforcement being supported at each said panel intersection by attachment to the upper end of said inclined compression strut and following an essentially parabolic curve between adjacent said inclined compression struts; and means of attachment therefor;

whereby the kinetic energy of a projectile impacting said flexible projectile arresting device is transferred and dissipated, without high energy rebound of said projectile and with said flexible projectile arresting device returning to its original position after impact.

2. The flexible projectile arresting device of claim 1 including a roof panel of flexible two-dimensional material extending between upper edges of said side panels and being continuously attached to said draped tension reinforcement; and means of attachment therefor.

3. In a projectile arresting device comprising a plurality of essentially vertical side panels of flexible two-dimensional material, said side panels being arranged contiguously in plan with vertical edges of adjacent said side panels attached continuously to one another at panel intersections and with lower edges of said side panels lying in a common horizontal ground plane; and means of attachment therefor; the improvement comprising:

(a) inclined compression struts of rigid linear material at each said intersection, the lower end of said inclined compression strut located in said ground plane, the upper end of said inclined compression strut located at the upper end of said intersection, said inclined compression strut making an angle with the vertical;

(b) tension guys of flexible linear material attached to each said inclined compression strut, said tension guy being attached to and extending from the ground plane to the upper end of said inclined compression strut, said tension guy making an angle with the vertical greater than that of said inclined compression strut; and means of attachment therefor;

(c) draped tension reinforcement of flexible linear material located continuously along and attached to the upper edges of each said side panel, said draped tension reinforcement being supported at each said panel intersection by attachment to the upper end of said inclined compression strut and following an essentially parabolic curve between adjacent said inclined compression struts; and means of attachment therefor;

whereby the kinetic energy of a projectile impacting said projectile arresting device is transferred and dissipated, without high energy rebound of said projectile and with said flexible projectile arresting device returning to its original position after impact.

4. The projectile arresting device of claim 3 including a roof panel of flexible two-dimensional material extending between upper edges of said side panels and being continuously attached to said draped tension reinforcement; and means of attachment therefor.

* * * * *